United States Patent [19]

Kracke et al.

[11] 3,991,448

[45] Nov. 16, 1976

[54] TRAVERSING DEVICE FOR WINDING A THREAD BUNCH ON A WARP BEAM

[75] Inventors: Jürgen Kracke; Hans-Peter Miemietz; Wilfried Derichs; Richer; Johann Stadelmann, all of Monchen-Gladbach, Germany

[73] Assignee: Gebruder Sucker, Monchen-Gladbach, Germany

[22] Filed: Feb. 23, 1976

[21] Appl. No.: 660,177

[30] Foreign Application Priority Data

Feb. 22, 1975 Germany ..... 2507750

[52] U.S. Cl. ..... 28/37; 28/55; 242/157 R

[51] Int. Cl.[2] ..... D02H 13/18

[58] Field of Search ..... 28/37, 54, 55; 242/157 R, 157.1, 158; 139/192

[56] References Cited

UNITED STATES PATENTS

| | | | |
|---|---|---|---|
| 252,089 | 1/1882 | Entwistle | 28/55 |
| 2,033,738 | 3/1936 | Reiners et al. | 28/37 |
| 2,066,888 | 1/1937 | Kahlisch | 28/37 |

*Primary Examiner*—Louis K. Rimrodt
*Attorney, Agent, or Firm*—Herbert L. Lerner

[57] ABSTRACT

Traversing device for winding a thread bunch on a warp beam having respective beam discs at the ends thereof includes comb means extending along the entire length of the warp beam that is to be wound by the thread bunch, the comb means includes a relatively long middle comb and two relatively short end combs located, respectively, at opposite ends of the middle comb, the end combs having a multiplicity of comb needles and being pivotable relative to the middle comb so as to execute a traversing stroke reducing in direction toward the respective beam disc.

10 Claims, 5 Drawing Figures

TRAVERSING DEVICE FOR WINDING A THREAD BUNCH ON A WARP BEAM

The invention relates to a traversing device for winding a thread bunch on a warp beam and, more particularly, by means of a tripartite comb extending over the entire width of the winding area or wrapping.

Generally, a one-part comb is used for traversing. It has been found to be particularly disruptive that the wrapping i.e. the respective layer of windings, becomes furrowed or grooved for increased thread spacings. In such a case, the traversing stroke should be greater, the greater the spacing between the threads. Since the width of the on-running thread bunch is smaller than the spacing between the beam discs, smaller wrapping diameter is obtained at the beam discs than in the middle of the beam. The region of smaller wrapping diameter becomes all the wider, the greater the traversing stroke. The traversing stroke has a critical limit which, when exceeded, results in the disturbed wrapping edges being no longer tolerable or permissible.

It is accordingly an object of the invention to provide a traversing device for winding a thread bunch on a warp beam, in accordance with the invention, which avoids the heretofore occurring disturbances at the edges of the beam wrapping as are caused especially due to large traversing strokes which are necessary to provide furrow-free winding layers.

With the foregoing and other objects in view, there is provided, in accordance with the invention, a traversing device for winding a thread bunch on a warp beam having respective beam discs at the ends thereof, comprising comb means extending along the entire length of the warp beam that is to be wound by the thread bunch, the comb means comprising a relatively long middle comb and two relatively short end combs located, respectively, at opposite ends of the middle comb, the end combs having a multiplicity of comb needles and being pivotable relative to the middle comb so as to execute a traversing stroke reducing in direction toward the respective beam disc.

In accordance with another feature of the invention, the end combs during the traversing operation are always disposed at an angle $\alpha$ other than 0° and 90° with respect to the axis of the middle comb.

In accordance with a further feature of the invention, the traversing device includes a rotatable member, such as a ball or the like, located on the respective end comb and engaging with the inner surface of the respective beam disc.

In accordance with an added feature of the invention, the traversing device includes a connecting rod connected to the respective end comb and carrying a ball socket, the ball being rotatably mounted in the ball socket.

In accordance with an additional feature of the invention, the connecting rod is crank-shaped in a manner reducing the spacing of the outer edge of the respective end comb from the inner surface of the respective beam disc.

In accordance with yet another feature of the invention, the connection rod is pivotally connected to the ball socket and to the respective end comb.

In accordance with yet a further feature of the invention, the connecting rod together with an end of the respective end comb is disposed on a rocking lever.

In accordance with yet an additional feature of the invention, the traversing device includes tension spring means for biasing the respective end comb against the respective beam disc.

In accordance with a concomitant feature of the invention, the tension spring means are suspended between the middle comb and the respective connecting rod.

Although the invention is illustrated and described herein as embodied in traversing device for winding a thread bunch on a warp beam, it is nevertheless not intended to be limited to the details shown, since various modifications and structural changes may be made therein without departing from the spirit of the invention and within the scope and range of equivalents of the claims.

The construction and method of the invention, however, together with additional objects and advantages thereof will be best understood from the following description of specific embodiments when read in connection with the accompanying drawings, in which.

Figure 1:
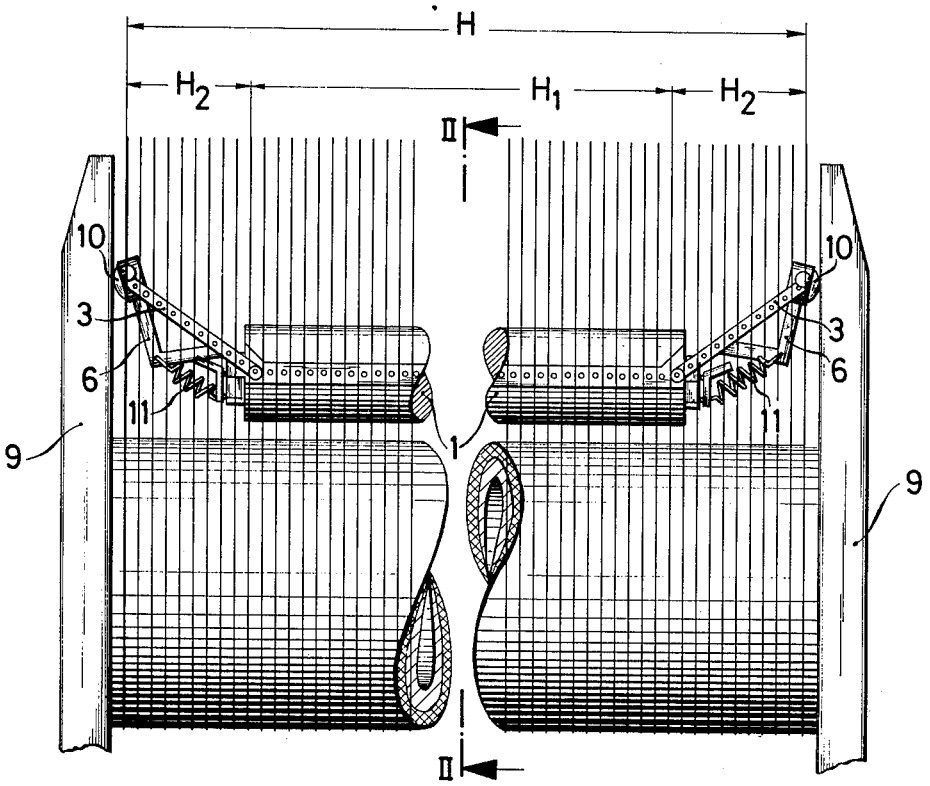
FIG. 1 is a diagrammatic top plan view, partly broken away, of the traversing device for winding a thread bunch on a warp beam in accordance with the invention, showing a middle comb with two end combs.
Figure 2:
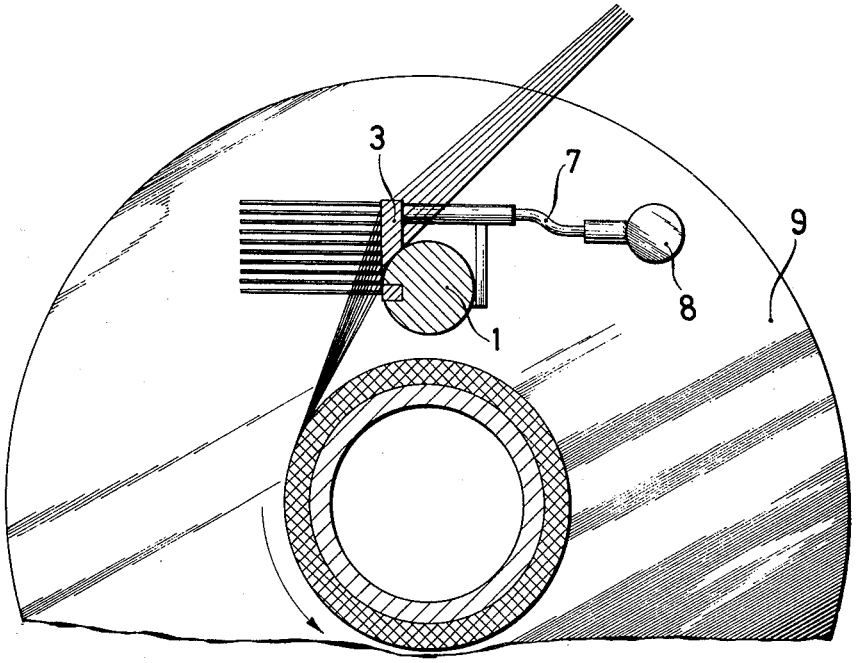
FIG. 2 is a cross-sectional view of FIG. 1 taken along the line II—II in the direction of the arrows.
Figure 3:
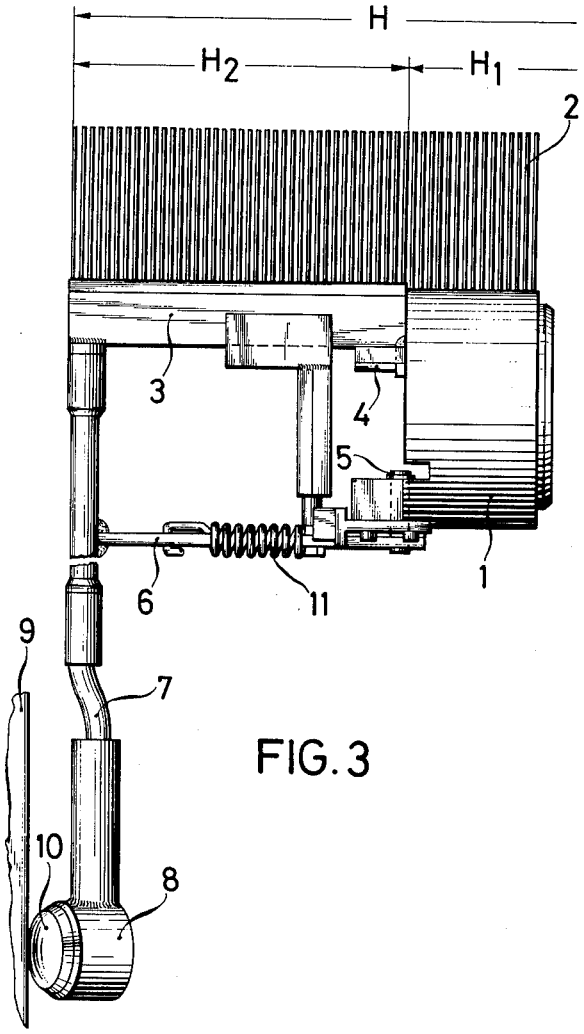
FIG. 3 is an enlarged side elevational view of the traversing device as seen from the right-hand side of FIG. 1 with the warp beam and beam disc or pulley removed.
Figure 4:
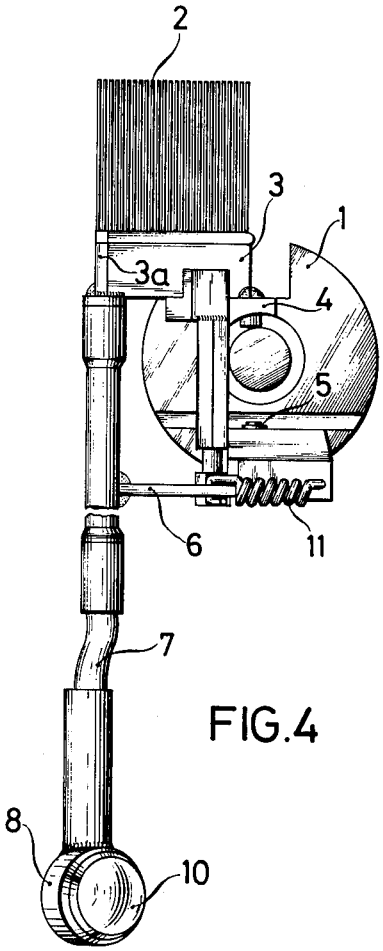
FIG. 4 is a view of the device as seen from the left-hand side of FIG. 3.

Referring now to the drawing and first, particularly, to FIGS. 1 to 4 thereof, there is shown a traversing device for winding a thread bunch on a warp beam according to the invention. For this purpose, a comb beam, of which an end portion 1 is visible, is provided with a defined comb spacing or division 2. The comb beam is provided at both ends thereof with a respective extension in the form of a pivotable end comb 3. The latter is articulatingly connected to the respective comb beam end portions 1 through a double hinge or articulating joint 4, 5 by means of a rocking lever 6, which is forcibly guided by a respective beam pulley or disc 9 through the intermediary of a ball 10 mounted in a ball socket 8 and a crank-shaped connecting rod 7. The cranked shaped of the connecting rod 7 is provided in order that the outer edge 3*a* of the respective end comb 3 should come closer to the beam disc or pulley 9, whereby the spacing between the beam disc or pulley 9 and the last thread is minimized. Of course, a roller (not shown) can be used, for example, instead of the ball 10. In order to maintain a uniform or constant compressive force between the beam disc or pulley 9 and the ball 10, a tension spring 11 is provided which is suspended from the rocking lever 6 to the respective end portion 1 of the comb beam.

Figure 5:
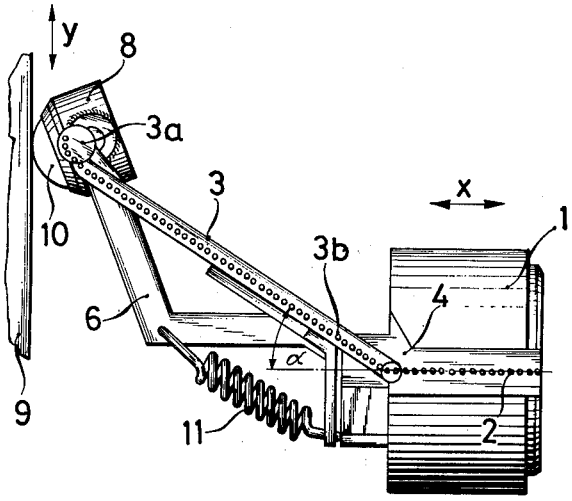
FIG. 5 is an enlarged fragmentary view of FIG. 1 showing the lefthand side of the device.

The mode of operation of the device of the invention is best understandable from FIG. 5. The traverse or traversing movement x of the middle comb 1 is transformed through the rocking lever 6 into a reciprocating movement *y* of the ball 10 on the beam disc or pulley 9. If the movement of the needles of the end comb 3 is divided, respectively, in the *x* and *y* direction, a reducing value is thus obtained for the movement in *x* direction toward the beam disc or pulley 9, as seen in FIG. 5. According to FIG. 1, the width H of the traversed thread bunch is divided into a uniform or constant stretch H1 and a variable stretch H2 tending toward a limit value of zero. With the reduction of the traversal or traverse stroke of the threads in both end combs 3 toward the respective beam discs or pulleys 9, the same winding diameter as in the middle of the beam 1 can be attained thereat.

As noted hereinbefore, the invention of the instant application is not limited to the illustrated and hereinbefore described embodiment but rather, further features are conceivable within the scope of the following claims. For example, the warp beam can be wound in both rotary directions. The invention of the instant application can, furthermore, be employed to particular advantage when the thread bunch that is to be wound is formed of flat threads.

There are claimed:

1. Traversing device for winding a thread bunch on a warp beam having respective beam discs at the ends thereof comprising comb means extending along the entire length of the warp beam that is to be wound by the thread bunch, said comb means comprising a relatively long middle comb and two relatively short end combs located, respectively, at opposite ends of said middle comb, said end combs having a multiplicity of comb needles and being pivotable relative to said middle comb so as to execute a traversing stroke reducing in direction toward the respective beam disc.

2. Traversing device according to claim 1 wherein said end combs during the traversing operation are always disposed at an angle other than 0° and 90° with respect to the axis of said middle comb.

3. Traversing device according to claim 1 including a rotatable member located on the respective end comb and engaging with the inner surface of the respective beam disc.

4. Traversing device according to claim 3 wherein said rotatable member is a ball.

5. Traversing device according to claim 3 comprising a connecting rod connected to the respective end comb and carrying a ball socket, said ball being rotatably mounted in said ball socket.

6. Traversing device according to claim 5 wherein said connecting rod is crank-shaped in a manner reducing the spacing of the outer edge of the respective end comb from the inner surface of the respective beam disc.

7. Traversing device according to claim 5 wherein said connecting rod is pivotally connected to said ball socket and to the respective end comb.

8. Traversing device according to claim 5 wherein said connecting rod together with an end of the respective end comb is disposed on a rocking lever.

9. Traversing device according to claim 5 including tension spring means for biasing the respective end comb against the respective beam disc.

10. Traversing device according to claim 9 wherein said tension spring means are suspended between said middle comb and the respective connecting rod.

* * * * *

UNITED STATES PATENT AND TRADEMARK OFFICE

CERTIFICATE OF CORRECTION

PATENT NO. : 3,991,448

DATED : November 16, 1976

INVENTOR(S) : Jürgen Kracke, Hans-Peter Miemietz, Wilfried Derichs, Werner Richter and Johann Stadelmann It is certified that error appears in the above-identified patent and that said Letters Patent are hereby corrected as shown below:

In the heading to the printed specification, line 4, change "Miemietz; Wilfried Derichs; Richer;" to read --Miemietz; Wilfried Derichs; Werner Richter;--

Signed and Sealed this

Thirty-first Day of May 1977

[SEAL]

*Attest:*

RUTH C. MASON
*Attesting Officer*

C. MARSHALL DANN
*Commissioner of Patents and Trademarks*